US009372010B2

(12) United States Patent
Jung et al.

(10) Patent No.: US 9,372,010 B2
(45) Date of Patent: Jun. 21, 2016

(54) APPARATUS, METHOD FOR CONTROLLING ONE OR MORE OUTDOOR DEVICES, AND AIR CONDITIONING SYSTEM HAVING THE SAME

(75) Inventors: Jaesik Jung, Seoul (KR); Duckgu Jeon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 441 days.

(21) Appl. No.: 13/192,621

(22) Filed: Jul. 28, 2011

(65) Prior Publication Data

US 2012/0179297 A1 Jul. 12, 2012

(30) Foreign Application Priority Data

Jan. 11, 2011 (KR) ..... 10-2011-0002842

(51) Int. Cl.
*G05D 23/19* (2006.01)
*F24F 11/00* (2006.01)

(52) U.S. Cl.
CPC ..... *F24F 11/006* (2013.01); *F24F 2011/0067* (2013.01); *F24F 2011/0068* (2013.01); *F24F 2221/52* (2013.01)

(58) Field of Classification Search
CPC ..... F24F 11/006; F24F 2011/0067; F24F 2011/0068; F24F 2221/52
USPC ..... 700/276, 278, 299, 300
See application file for complete search history.

(56) References Cited

U.S. PATENT DOCUMENTS 4,149,590 A * 4/1979 Ospelt ..... 165/53
4,215,408 A * 7/1980 Games et al. ..... 700/278
4,280,332 A * 7/1981 Khan et al. ..... 62/156
5,355,323 A * 10/1994 Bae ..... 700/276
5,775,116 A * 7/1998 Matsumoto et al. ..... 62/155
5,832,735 A * 11/1998 Matsumoto et al. ..... 62/151
6,257,317 B1 * 7/2001 DeGregoria et al. ..... 165/8
6,289,974 B1 * 9/2001 DeGregoria et al. ..... 165/8
6,591,620 B2 * 7/2003 Kikuchi et al. ..... 62/126
6,679,321 B2 * 1/2004 Jin ..... 165/236
6,968,707 B2 * 11/2005 Violand et al. ..... 62/89
6,983,794 B2 * 1/2006 Fujimoto ..... 165/231
7,114,343 B2 * 10/2006 Kates ..... 62/126
7,201,006 B2 * 4/2007 Kates ..... 62/129
7,275,377 B2 * 10/2007 Kates ..... 62/129
7,322,532 B2 * 1/2008 Takada et al. ..... 236/11
7,331,187 B2 * 2/2008 Kates ..... 62/129

(Continued)

FOREIGN PATENT DOCUMENTS

KR 10-2002-0094659 12/2002
KR 10-2007-0107324 11/2007

OTHER PUBLICATIONS

Korean Office Action dated Aug. 3, 2012.

*Primary Examiner* — Charles Kasenge
(74) *Attorney, Agent, or Firm* — KED & Associates, LLP

(57) ABSTRACT

An apparatus, a method for controlling one or more outdoor devices, and an air conditioning system are provided. A freezing prevention function for an outdoor device may be activated or deactivated based on weather information received from an external weather information providing server or weather information input by a user, and freezing prevention may be performed using state and operation information of the outdoor device as necessary. Thus, user convenience may be improved, stability of the outdoor device and an air conditioning system having the same enhanced, and operation efficiency improved.

29 Claims, 5 Drawing Sheets

(56) References Cited

U.S. PATENT DOCUMENTS

| | | | | |
|---|---|---|---|---|
| 7,343,751 | B2 * | 3/2008 | Kates | 62/129 |
| 7,424,343 | B2 * | 9/2008 | Kates | 700/276 |
| 7,469,546 | B2 * | 12/2008 | Kates | 62/129 |
| 7,908,117 | B2 * | 3/2011 | Steinberg et al. | 702/182 |
| 8,219,249 | B2 * | 7/2012 | Harrod et al. | 700/276 |
| 2003/0042014 | A1 * | 3/2003 | Jin | 165/240 |
| 2004/0007008 | A1 * | 1/2004 | Benatav | 62/324.6 |
| 2004/0177627 | A1 * | 9/2004 | Fujimoto | 62/151 |
| 2006/0026974 | A1 * | 2/2006 | Takada et al. | 62/150 |
| 2006/0036349 | A1 * | 2/2006 | Kates | 700/276 |
| 2006/0037349 | A1 * | 2/2006 | Kang et al. | 62/323.3 |
| 2006/0149422 | A1 * | 7/2006 | Dunstan et al. | 700/276 |
| 2007/0012418 | A1 * | 1/2007 | Cho et al. | 165/58 |
| 2007/0137238 | A1 * | 6/2007 | Hu | 62/277 |
| 2008/0016888 | A1 * | 1/2008 | Kates | 62/127 |
| 2008/0028773 | A1 * | 2/2008 | Lee et al. | 62/80 |
| 2008/0035318 | A1 * | 2/2008 | Kamada et al. | 165/133 |
| 2008/0051945 | A1 * | 2/2008 | Kates | 700/295 |
| 2008/0078842 | A1 * | 4/2008 | MacDonald | 236/44 R |
| 2008/0120335 | A1 * | 5/2008 | Dolgoff | 707/104.1 |
| 2008/0216495 | A1 * | 9/2008 | Kates | 62/129 |
| 2008/0223051 | A1 * | 9/2008 | Kates | 62/129 |
| 2009/0187281 | A1 * | 7/2009 | Kates | 700/275 |
| 2009/0272518 | A1 * | 11/2009 | Jeon et al. | 165/253 |
| 2010/0070086 | A1 * | 3/2010 | Harrod et al. | 700/276 |
| 2011/0048053 | A1 * | 3/2011 | Sekine | 62/324.6 |
| 2011/0048054 | A1 * | 3/2011 | Sekine | 62/324.6 |
| 2012/0085113 | A1 * | 4/2012 | Tran et al. | 62/186 |

* cited by examiner

FIG. 3
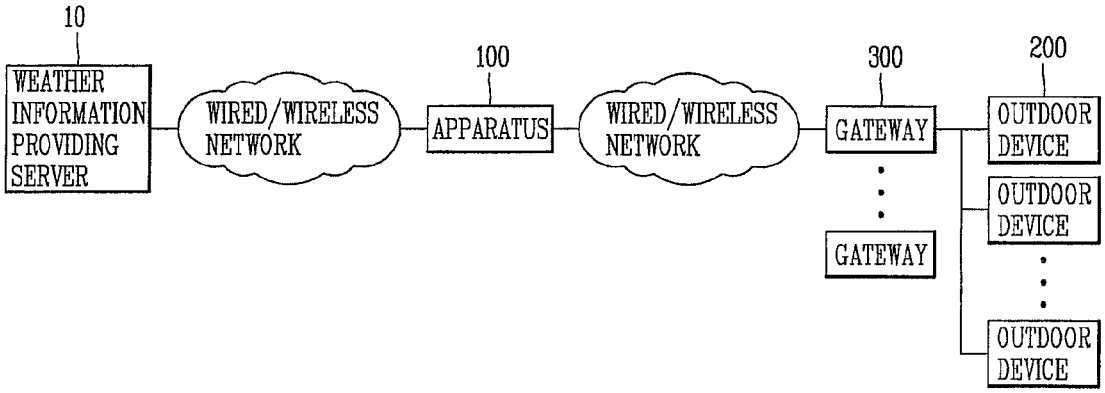
FIG. 4
| 7 | 6 | 5 | 4 | 3 | 2 | 1 | 0 |
|---|---|---|---|---|---|---|---|
| SET | CHECK | | | | | | |
FIG. 5
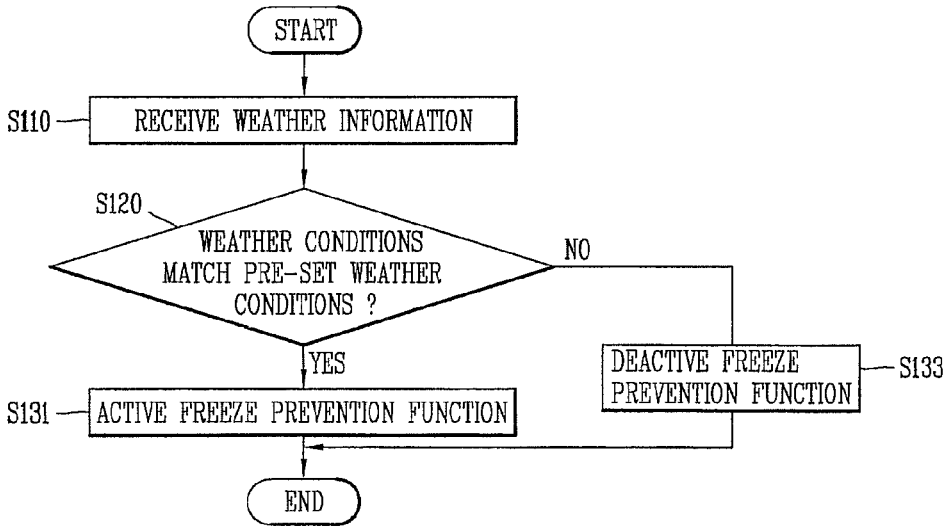

APPARATUS, METHOD FOR CONTROLLING ONE OR MORE OUTDOOR DEVICES, AND AIR CONDITIONING SYSTEM HAVING THE SAME

BACKGROUND

1. Field

An apparatus, method for controlling one or more outdoor devices, and an air conditioning system including the same are disclosed herein.

2. Background

Air conditioning systems are known. However, they suffer from various disadvantages.

BRIEF DESCRIPTION OF THE DRAWINGS

Embodiments will be described in detail with reference to the following drawings in which like reference numerals refer to like elements, and wherein:

FIG. 3 is a schematic block diagram of an air conditioning system according to another embodiment;

FIG. 4 is a view illustrating definition of a protocol of a signal for activating or deactivating a freeze prevention function according to an embodiment;

FIGS. 5 to 7 are flow charts of a control method according to an embodiment.

DETAILED DESCRIPTION

Figure 1:
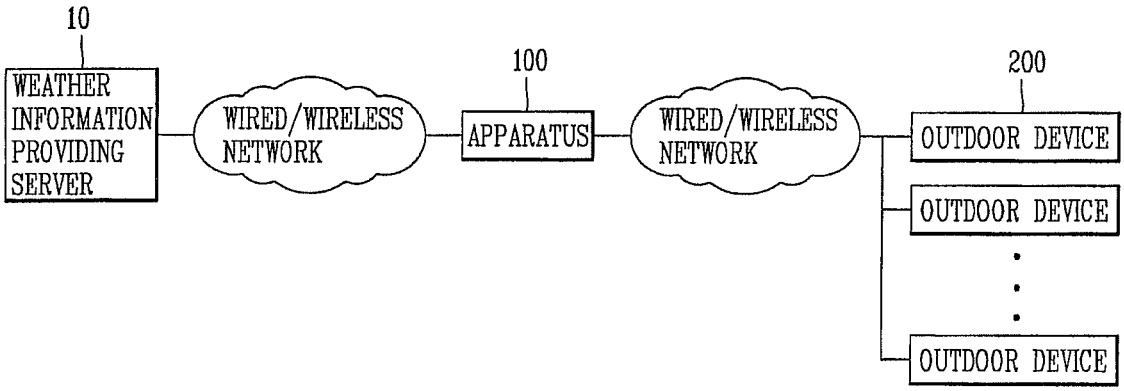
FIG. 1 is a schematic block diagram of an air conditioning system according to an embodiment.

In general, an air conditioner may include an indoor unit or device and an outdoor unit or device and drive a refrigerating and heating cycle according to a user demand. The indoor device and the outdoor device may be connected via a refrigerant pipe. Recently, air conditioning systems have been configured to include a control device that controls a plurality of multi-air conditioners which are connected.

Further, recently, air conditioning systems have included an air conditioner controller in order to increase the efficiency of air conditioner management in a communal building, such as a company, or school, in which an air conditioner is installed. In such recent air conditioning systems, as the performance of an outdoor device is improved, a larger number of indoor devices may be shared and connected to an outdoor device, and a plurality of multi-air conditioners may be integratedly or collectively controlled by an air conditioner controller. Also, such recent air conditioning systems may include a remote control server that is able to remotely control the plurality of multi-air conditioners, and the plurality of multi-air conditioners may be controlled and a state or operation monitored through or by the remote control server or information.

As the refrigerating and heating capacity increases, outdoor devices are largely installed at an outer side of a building and are designed to be resistant to external environment conditions, such as rain, or snow. In particular, when it's rainy or snowy and the temperature is low, a fan of the outdoor device may freeze or cause an error, potentially resulting in a system failure, so the outdoor devices may have a freeze prevention function.

However, because outdoor devices are installed at an outer side of a building, there is a difficulty in their maintenance, and in particular, because the outdoor devices are operated in a state in which the freeze prevention function is set, power consumption is increased and energy wasted. Also, related art outdoor device and the air conditioning systems including the same may have a problem in that a user, such as a maintenance manager, must directly visit the outdoor devices in order to set or activate, or release or deactivate the freeze prevention function according to weather conditions.

An apparatus, a method for controlling one or more outdoor devices using the apparatus, and an air conditioning system including the same will now be described in detail with reference to the accompanying drawings. Where possible, like reference numerals have been used to indicate like elements, and repetitive disclosure has been omitted.

Hereinafter, freeze may include a weather condition in which an outdoor device has or indicates an error because it is frozen and/or covered with snow, so it does not operate or does not operate properly. The apparatus may include a server, a module, a unit, or a system, and may be configured to control an outdoor device or a gateway from a remote area. Further, activating a freeze prevention function may include activating the freeze prevention function, confirming activation of the freeze prevention function, and/or maintaining activation of the freeze prevention function. Deactivating the freeze prevention function may include deactivating the freeze prevention function, confirming deactivation of the freeze prevention function, and/or maintaining deactivation of the freeze prevention function.

With reference to FIG. 1, an air conditioning system according to an embodiment may include one or more outdoor devices 200 installed at an outer side of a building and configured to perform air conditioning with respect to the building, and an apparatus 100 connected to an external weather information providing server 10 and configured to receive weather information regarding an area in which the one or more outdoor devices 200 is installed, and activate or deactivate a freeze prevention function of the one or more outdoor devices 200 based on the received weather information. The outdoor devices 200 may be connected to indoor devices which may be installed in each room of the building to perform air conditioning.

The weather information providing server 10 may provide weather information, such as current temperature, current humidity, direction of the wind, wind velocity, weather trends such as whether it is cloudy or sunny, sunrise time or sunset time, highest temperature or lowest temperature, highest humidity or lowest humidity, estimated rainfall, expected snowfall, of an area where the air conditioning system or the outdoor devices are installed.

The apparatus 100 may be a remote control apparatus. Further, the apparatus 100 may be connected to the weather information providing server 10 through, for example, a wireline, wirelessly, or by a satellite. For example, the apparatus 100 may be connected to the weather information providing server 10 through the Internet. Also, the apparatus 100 may be connected with the one or more outdoor devices 200 through the wired/wireless Internet. Of course, the apparatus 100 may also be connected with the weather information providing server 10 or the outdoor devices 200 according to a different communication scheme, for example, through power line communication, or mobile communication, and the like.

Figure 2:
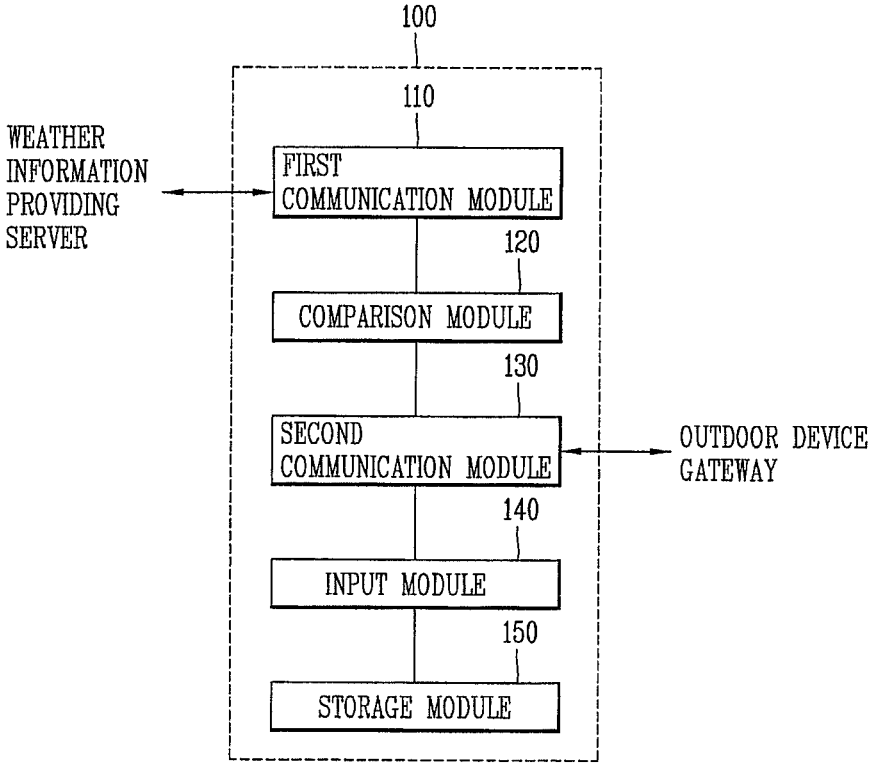
FIG. 2 is a schematic block diagram of an apparatus according to an embodiment.

With reference to FIG. 2, the apparatus 100 may include a first communication module 110 that receives weather information from the weather information providing server 10, a comparison module 120 that compares the weather information and pre-set weather conditions and generates a signal for setting or activating (or for confirming activation of or maintaining activation of), or releasing or deactivating (or for confirming deactivation of or maintaining deactivation of) the freeze prevention function according to the comparison results, and a second communication module 130 that transmits the signal to the one or more outdoor devices 200. The first communication module 110, the comparison module 120, and the second communication module 130 may be provided in the form of or as part of a processor.

The first communication module 110 may be connected to the weather information providing server 10 through, for example, a wireline, wirelessly, or through a satellite, and the second communication module 130 may be connected to the one or more outdoor devices 200 through a wireline or wirelessly. The first and second communication modules 110 and 130 may be, for example, Internet communication modules, respectively.

The comparison module 120 may compare the weather information received by the first communication module 110 with the pre-set weather conditions. That is, the comparison module 120 may extract information required for activating or deactivating the freeze prevention function from weather information and compare the extracted information with the conditions required for activating or deactivating the freeze prevention function. For example, the comparison module 120 may extract weather information, such as information that the temperature is approximately 4° C. and the humidity is approximately 80% or greater, or information that the temperature is approximately 2° C., a rainfall (snowfall) probability is approximately 90%, and an expected snowfall is approximately 3 cm. Then, the comparison module 120 may compare the extracted weather information with the weather conditions. The weather conditions may include, for example, temperature, humidity, rainfall probability, an amount of rainfall, a probability of precipitation, and/or an amount of precipitation. For example, the weather conditions may be set such that the temperature is approximately 3° C. or lower, and the humidity is approximately 90% or lower. The weather conditions may be set to be different for each outdoor device, and may be previously set by the user, or may be set according to data, such as statistics.

With reference to FIG. 2, the apparatus 100 may further include an input module 140 that receives the weather information or receives a control command for activating or deactivating the freeze prevention function. The input module 140 may be provided as part of the processor.

A user, who may be, for example, a maintenance manager, may directly input a control command to an outdoor device to activate or deactivate the freeze prevention function of the outdoor device through the input module 140. Also, the user may input weather information collected from the weather information providing server 10 or weather information collected through a different means to the apparatus 100. The user, even when in a different area, may be connected to the apparatus 100 and may input a control command or weather information through, for example, the Internet, or mobile communication. The comparison module 120 may compare the weather information received through the first communication module 110 or weather information received through the input module 14 with the weather conditions.

With reference to FIG. 2, the apparatus 100 may further include a storage module 150 that stores weather information received through the first communication module 110 or received through the input module 140. The storage module 150 may previously store the weather conditions as a reference for activating or deactivating the freeze prevention function, as well as operation conditions (to be described) required for starting or terminating the freeze prevention function. The storage module 150 may be provided as part of the processor.

In the apparatus 100, the second communication module 130 may receive state information and operation information from each of the outdoor devices 200. In this case, the comparison module 120 may compare the state information and operation information regarding each of the outdoor devices 200 with the pre-set operation conditions for activating the freeze prevention function with respect to a corresponding outdoor device, and activate or deactivate the freeze prevention function of the corresponding outdoor device. The operation conditions may be set to be the same as the weather conditions with respect to the corresponding outdoor device, or may be set with reference to the state information or the operation information of the corresponding outdoor device. For example, the operation conditions may be set as conditions when the temperature is approximately 3° C. or lower and a fan provided at or in the outdoor device may be stopped, or conditions when a stoppage duration of the fan provided at or in the outdoor device exceeds approximately 30 minutes at a temperature of approximately 3° C. or lower.

Meanwhile, each of the outdoor devices 200 may receive a signal from the apparatus 100, and when the signal is a signal for activating the freeze prevention function, the corresponding function of each of the outdoor devices 200 may be activated. When the freeze prevention function is activated, each of the outdoor devices may compare the state information and operation information of the respective outdoor device with the operation conditions for activating the freeze prevention function, and activate or deactivate the freeze prevention function based on the comparison results. As described above, the operation conditions may be set to be the same as the weather conditions with respect to the corresponding outdoor device, or may be set with reference to the state information or the operation information of the corresponding outdoor device. For example, the operation conditions may be set as conditions when the temperature is approximately 3° C. or lower and a fan provided at or in the outdoor device is stopped, or as conditions when a stoppage duration of the fan provided at or in the outdoor device exceeds approximately 30 minutes at a temperature of approximately 3° C. or lower.

Each of the outdoor devices 200 may include a control device to perform the freeze prevention function. The control device may include a fan rotated to prevent freezing, an electric motor that drives the fan, an inverter that converts input power and drives the electric motor using the converted power, and a controller that determines whether or not the freeze prevention function has been activated and controls the inverter by comparing state information and operation information of the outdoor devices with pre-set operation conditions. The outdoor device 200 may drive the fan at a certain speed, for example, approximately 850 rpm, for a certain period of time, for example, approximately 120 seconds, in order to prevent freezing. Also, the outdoor device 200 may repeatedly drive the fan at every certain period, for example, every approximately 30 minutes.

With reference to FIG. 3, the air conditioning system according to an one embodiment may include one or more outdoor devices 200 installed at an outer side of a building that performs air conditioning with respect to the building, an apparatus 100 connected to an external weather information providing server 10 that receives weather information regarding an area in which the one or more outdoor devices 200 is installed and activates or deactivates a freeze prevention function of the one or more outdoor devices 200 based on the received weather information, and one or more gateways 300 connected between the apparatus 100 and the one or more outdoor devices.

The apparatus 100 may be a remote control apparatus. Further, the apparatus 100 may be connected to the weather information providing server 10 through, for example, a wireline, wirelessly, or by a satellite. For example, the apparatus 100 may be connected to the weather information providing server 10 through the Internet. Also, the apparatus 100 may be connected with the gateways 300 through the wired/wireless Internet. Of course, the apparatus 100 may also be connected with the weather information providing server 10 or the gateways 300 according to a different communication scheme, for example, through power line communication or mobile communication. Also, the gateways 300 and the one or more outdoor devices 200 may be connected through one or more communication schemes, including, but not limited to wireless communication, serial communication, pipe communication, power line communication, and LAN.

The one or more gateways 300 may be provided in the air conditioning system, and each of the gateways 300 may be connected to the one or more outdoor devices 200. The one or more gateways 300 may include a control program that stores previously set information, such as network information regarding indoor devices or outdoor devices, device information regarding the indoor devices and outdoor devices, and controls the outdoor devices and indoor devices according to the registered or previously set information.

The one or more gateways 300 may serve as connection passages through which the apparatus 100 may control the one or more outdoor devices 200. The one or more gateways 300 may receive the state information and operation information of the one or more outdoor devices 200 from the one or more outdoor devices 200 and transmit the received information to the apparatus 100, and may receive a signal from the apparatus 100 and deliver the same to the one or more outdoor devices 200. The one or more gateways 300 may receive a signal for operating the devices, such as the one or more outdoor devices, from the apparatus 100 and deliver the received signal to a corresponding outdoor device. The signal may include a command for activating or deactivating a freezing prevention function.

The apparatus 100 may receive state information and operation information from the respective outdoor devices 200. In this case, the apparatus 100 may compare the state information and operation information regarding each of the one or more outdoor devices 200 with pre-set operation conditions for activating the freeze prevention function with respect to a corresponding outdoor device, and activate or deactivate the freeze prevention function of the corresponding outdoor device. The operation conditions may be set to be the same as the weather conditions with respect to the corresponding outdoor device, or may be set with reference to the state information or the operation information of the corresponding outdoor device. For example, the operation conditions may be set as conditions when the temperature is approximately 3° C. or lower and a fan provided at or in the outdoor device is stopped, or as conditions when a stoppage duration of the fan provided at or in the outdoor device exceeds approximately 30 minutes at a temperature of approximately 3° C. or lower.

Meanwhile, each of the one or more outdoor devices 200 may receive a signal via the gateways 300, and when the signal is a signal for activating the freeze prevention function, the corresponding function of each of the outdoor devices 200 may be activated. When the freeze prevention function is activated, each of the one or more outdoor units 200 may compare the state information and operation information of the respective outdoor device with the operation conditions for activating the freeze prevention function, and may activate or deactivate the freeze prevention function based on the comparison results. As described above, the operation conditions may be set to be the same as the weather conditions with respect to the corresponding outdoor device, or may be set with reference to the state information or the operation information of the corresponding outdoor device. For example, the operation conditions may be set as conditions when the temperature is approximately 3° C. or lower and a fan provided at or in the outdoor device is stopped, or conditions when a stoppage duration of the fan provided at or in the outdoor device exceeds approximately 30 minutes at a temperature of approximately 3° C. or lower.

Each of the one or more outdoor devices 200 may include a control device to perform the freeze prevention function. The control device may include a fan that rotates to prevent freezing, an electric motor that drives the fan, an inverter that converts input power and drives the electric motor using the converted power, and a controller that determines whether or not the freeze prevention function has been activated and controls the inverter by comparing state information and operation information of the respective outdoor device with pre-set operation conditions. The respective outdoor device 200 may drive the fan at a certain speed, for example, approximately 850 rpm, for a certain period of time, for example, approximately 120 seconds, in order to prevent freezing. Also, the outdoor device 200 may repeatedly drive the fan at every certain period, for example, every approximately 30 minutes.

With reference to FIG. 4, a protocol of a signal for activating or deactivating the freeze prevention function may be defined between the apparatus 100 and the outdoor devices 200 or between the apparatus 100 and the gateways 300. In a case in which the apparatus 100 controls the outdoor devices 200 using an 8-bit signal, as shown in FIG. 4, bit-7 may be defined to correspond to a command for activating the freeze prevention function and bit-6 may be defined to correspond to confirming activation of the freeze prevention function. In this case, when bit-7 and bit-6 are 11, they may be defined as a signal for activating the freeze prevention function, and when they are 10, they may be defined as a signal for deactivating the freeze prevention function. Meanwhile, when bit-7 and the bit-6 are 01, they may be defined as a signal for confirming a state in which the freeze prevention function is currently activated, and when bit-7 and the bit-6 are 00, they may be defined as a signal for confirming a state in which the freeze prevention function is currently deactivated, and may be coded such that they may be transmitted by the outdoor devices 100 to the apparatus 100.

With reference to FIG. 5, a method for controlling one or more outdoor devices using an apparatus connected to the one or more outdoor devices may include receiving weather information of an area in which the one or more outdoor devices are installed, in step S110; comparing the weather information with pre-set weather conditions, in step S120; and activating (or confirm activation) or deactivating (or confirm deactivation of) the freeze prevention function on the basis of the comparison results, in steps S131 and S132. In step S110 of receiving the weather information, the apparatus may be connected to an external weather information providing server, for example, wirelessly or through a wireline to receive the weather information or may receive weather information directly from a user. The apparatus described above with reference to FIGS. 1 to 3 may be employed for the method, and repetitive description has been omitted.

The apparatus may be connected to the weather information providing server through, for example, a wireline or wirelessly, and may receive weather information, in step S110. The apparatus may compare the weather information received by a first communication module with pre-set weather conditions, in step S120. The apparatus may extract information required for activating or deactivating the freeze prevention function from weather information and compare the extracted information with the conditions required for activating or deactivating the freeze prevention function. For example, the apparatus may extract weather information, such as information that the temperature is approximately 4° C. and the humidity is approximately 80% or greater, or information that the temperature is approximately 2° C., a rainfall (snowfall) probability is approximately 90%, and an expected snowfall is approximately 3 cm. The apparatus may compare the extracted weather information with the weather conditions, in step S120. The weather conditions may include, for example, temperature, humidity, rainfall probability, an amount of rainfall, a probability of precipitation, and an amount of precipitation. For example, the weather conditions may be set such that the temperature is approximately 3° C. or lower, and the humidity is approximately 90% or lower. The weather conditions may be set to be different for each outdoor device, and may be previously set by a user, or may be set according to data, such as statistics. When the weather information corresponds to the pre-set weather conditions, the apparatus may activate the freeze prevention function, in step S131, and when the weather information does not correspond to the weather conditions, the apparatus may deactivate the freeze prevention function, in step S133.

The apparatus may receive the weather information, in step S110, or may receive a control command for activating or deactivating the freeze prevention function. A user, who may include a maintenance manager, may directly input a control command to an outdoor device to activate or deactivate the freeze prevention function of the outdoor device. Also, the user may input weather information collected from the weather information providing server or weather information collected through a different means to the apparatus. The user, even when in a different area, may be connected to the apparatus and may input a control command or weather information through, for example, the Internet, or mobile communication.

Figure 6:
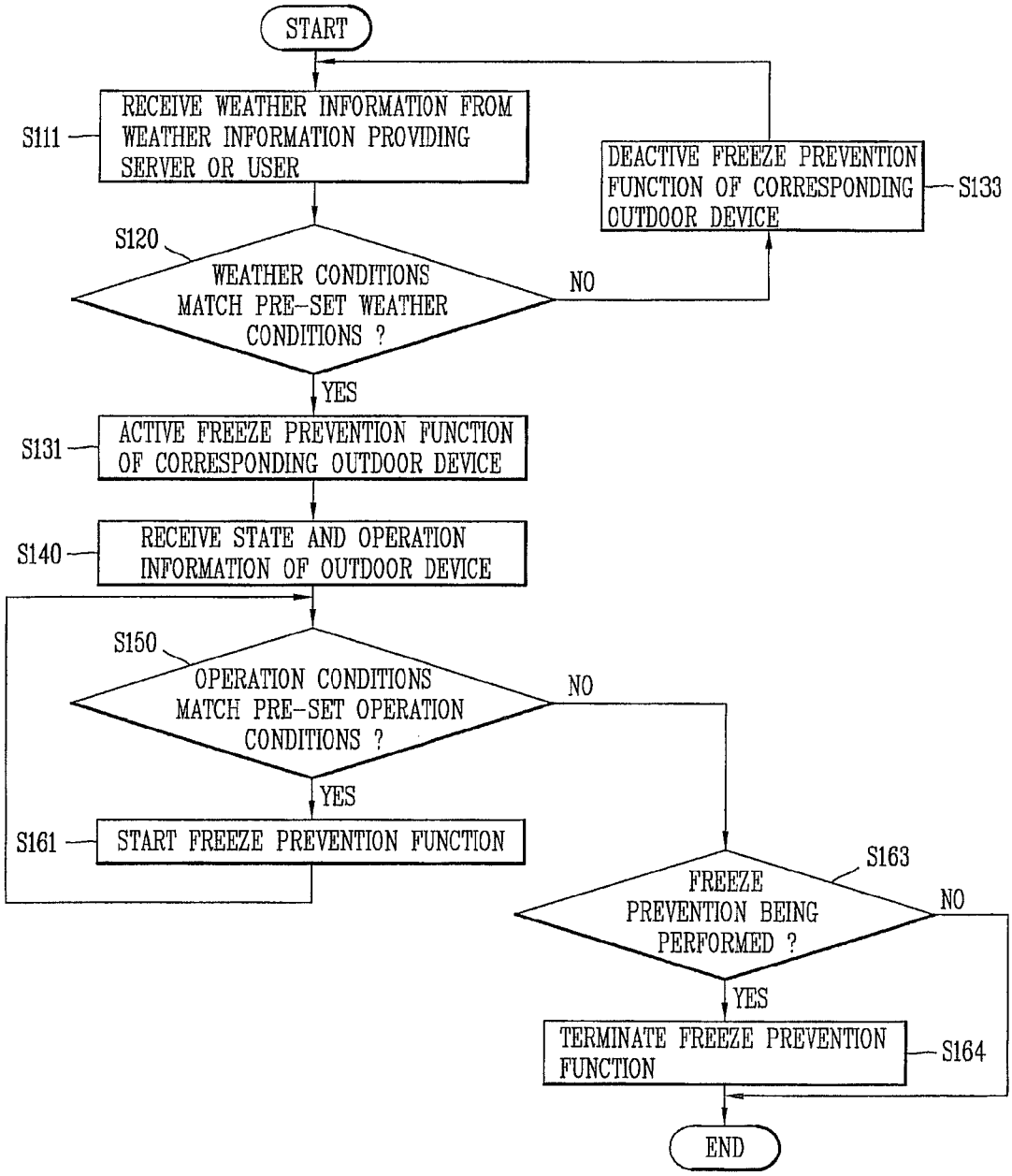

The control method may further include storing the weather information. The apparatus may previously store the weather information, including weather conditions used as a reference for activating or deactivating the freeze prevention function, and the operation conditions, required to activate or deactivate the freeze prevention function. With reference to FIG. 6, the control method may further include receiving state information and operation information from the outdoor devices, in step S140, comparing the state information and the operation information with pre-set operation conditions for performing the freeze prevention function of a corresponding outdoor device, in step S150, and starting or terminating the freeze prevention function of the corresponding outdoor device on the basis of the comparison results, in step S161 or step S165. In the step S150 of comparing the operation conditions, it may be determined whether or not the freeze prevention function of the corresponding outdoor device has been activated. When the freeze prevention function has been activated, the information may be compared with the pre-set operation conditions. The configuration of the apparatus has been described above with reference to FIGS. 1 to 3, and repetitive description has been omitted.

The apparatus may receive state information and operation information from each of the outdoor devices 200, compare the state information and operation information for each of the outdoor devices 200 with the pre-set operation conditions for performing the freeze prevention function with respect to a corresponding outdoor device, and start, in step S161, or terminate, in step S165, the freeze prevention function which is being executed. The operation conditions may be set to be the same as the weather conditions with respect to the corresponding outdoor device, or may be set with reference to the state information or the operation information of the corresponding outdoor device. For example, the operation conditions may be set as conditions when the temperature is approximately 3° C. or lower and a fan provided at or in the outdoor device is stopped, or as conditions when a stoppage duration of the fan provided at or in the outdoor device exceeds approximately 30 minutes at a temperature of approximately 3° C. or lower.

The freezing prevention function may be executed also in the one or more outdoor devices 200, as well as in the apparatus 100. The one or more outdoor devices 200 may receive a signal from the apparatus 100, and when the signal is a signal for activating the freeze prevention function, the corresponding function of each of the outdoor devices 200 may be activated. When the freeze prevention function is activated, each of the devices may compare the state information and operation information of the respective outdoor device with the pre-set operation conditions for performing the freeze prevention function, and start or terminate the freeze prevention function based on the comparison results. As described above, the operation conditions may be set to be the same as the weather conditions with respect to the corresponding outdoor device, or may be set with reference to the state information or the operation information of the corresponding outdoor device. For example, the operation conditions may be set as conditions when the temperature is approximately 3° C. or lower and a fan provided to the outdoor device is stopped, or conditions when a stoppage duration of the fan provided to the outdoor device exceeds approximately 30 minutes at a temperature of approximately 3° C. or lower. The outdoor device 200 may drive the fan at a certain speed, for example, approximately 850 rpm, for a certain period of time, for example, approximately 120 seconds, in order to prevent freezing. Also, the outdoor device 200 may repeatedly drive the fan at every certain period, for example, every approximately 30 minutes.

Figure 7:
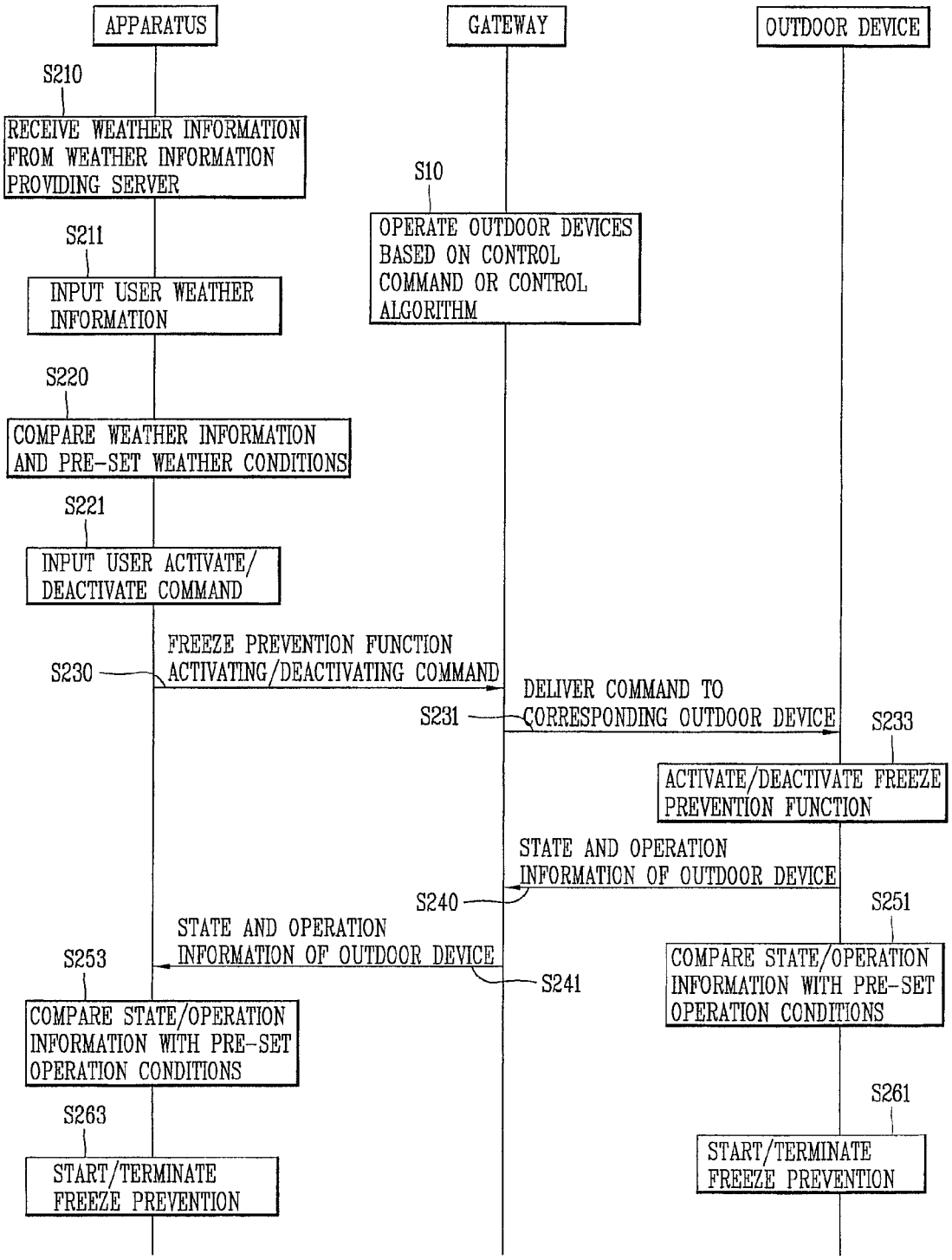

With reference to FIG. 7, a method of controlling an air conditioning system according to an embodiment may include receiving, by an apparatus, weather information regarding an area in which one or more outdoor devices is installed from a weather information providing server, in step S210; comparing, by the apparatus, the weather information with pre-set weather conditions, in step S220; and generating, by the apparatus, a signal for activating or deactivating the freeze prevention function based on the comparison results, in step S230. In this case, the apparatus may deliver the signal to the one or more outdoor devices through a gateway, in step S231. The method may further include receiving, via the apparatus, the weather information directly from the user, in step S211, and comparing the received pre-set weather information with the weather conditions, in step S220. Also, the method may include directly receiving a control command for activating or deactivating the freeze prevention function, in step S221, and generating a signal according to the directly received control command, in step S230. The method may further include receiving, via the apparatus, state information and operation information from the outdoor device, in step S241; comparing, via the apparatus, the state information and pre-set operation information with the operation conditions for performing the freeze prevention function of the corresponding outdoor device, in step S253; and starting or terminating the freeze prevention function of the corresponding outdoor device based on the comparison results, in step S263. The configuration of the apparatus has been described above with reference to FIGS. 1 to 3, so repeated description thereof with respect to FIGS. 5 and 6 has been omitted.

Further, the flow chart of FIG. 7 depicts a method for preventing, by the apparatus, an outdoor device from being frozen by using a gateway. The gateway may serve as a connection passage allowing the apparatus to control the outdoor device therethrough. The gateway may receive the state information and operation information of the outdoor device from the outdoor device, in step S240, and may transmit the received information to the apparatus, in step S241, and may receive a signal from the apparatus, in step S230, and deliver the same to the outdoor device, in step S231. The gateway may receive a signal for operating a device, such as the outdoor device, from the apparatus and deliver the received signal to the corresponding outdoor device, so that the outdoor device may be operated. The signal may include a command for activating or deactivating a freeze prevention function, in steps S230 and S231.

With further reference to FIG. 7, the outdoor device may receive a signal from the apparatus, and when the signal is a signal for activating the freeze prevention function, the corresponding function of the outdoor device may be activated, in step S233. When the freeze prevention function is activated, the outdoor device may compare the state information and operation information of the respective outdoor device with the pre-set operation conditions for performing the freeze prevention function, in step S251, and start or terminate the freeze prevention function based on the comparison results, in step S261. As described above, the operation conditions may be set to be the same as the weather conditions with respect to the corresponding outdoor device, or may be set with reference to the state information or the operation information of the corresponding outdoor device. For example, the operation conditions may be set as conditions when the temperature is approximately 3° C. or lower and a fan provided at or in the outdoor device is stopped, or conditions when a stoppage duration of the fan provided at or in the outdoor device exceeds approximately 30 minutes at a temperature of approximately 3° C. or lower.

A protocol of a signal for activating or deactivating the freeze prevention function may be defined between the apparatus and the outdoor device, or between the apparatus and the gateway, as shown in FIG. 4. In a case in which the apparatus controls the outdoor device using an 8-bit signal, bit-7 may be defined to correspond to a command for activating the freeze prevention function and bit-6 may be defined to correspond to confirming activation of the freeze prevention function. In a state in which the freeze prevention function is activated, the outdoor device may drive the fan at a certain speed, for example, approximately 850 rpm, for a certain period of time, for example, 120 seconds, in order to prevent freezing. Also, the outdoor device may repeatedly drive the fan at every certain period, for example, every approximately 30 minutes.

Figure 8:
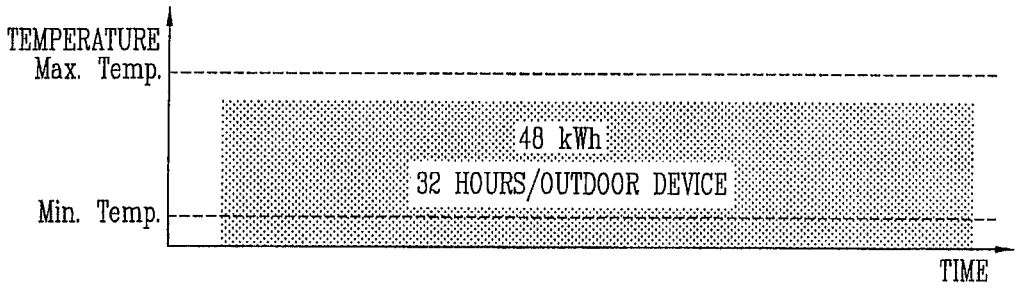
FIGS. 8 and 9 are graphs for explaining an effect according to an embodiment.
Figure 9:
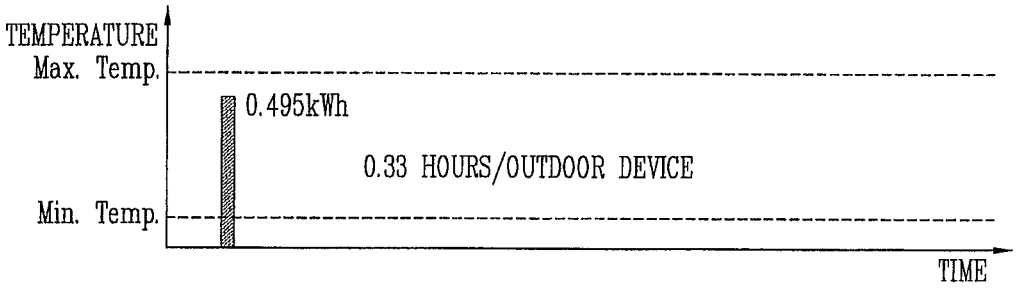

FIG. 8 is a graph showing outdoor device information measured after being set to constantly perform the freeze prevention function when the operation conditions are met, and FIG. 9 is a graph showing outdoor device information measured after the freeze prevention function is activated or deactivated through the apparatus according to an embodiment. The graphs of FIGS. 8 and 9 show the measurement results for a month. With reference to FIGS. 8 and 9, it is noted that a duration of performing the freeze prevention function by the outdoor device may be shortened to approximately 0.33 hours from approximately 32 hours, and power consumption may be reduced from approximately 48 kWh to approximately 0.495 kWh. While the change in values may vary according to, for example, installation environment or weather conditions, the application of the disclosed embodiment achieves a considerable effect.

As described above, according to the apparatus, a method for controlling one or more outdoor devices, and the air conditioning system including the same, the freeze prevention function of an outdoor device may be activated or deactivated based on weather information received from an external weather information providing server or weather information input by a user, and freeze prevention may be performed by using state and operation information of the outdoor device, as necessary. Thus, user convenience may be improved, stability of the outdoor device(s) and an air conditioning system having the same may be enhanced, and operation efficiency improved.

Embodiments disclosed herein provide an apparatus, a method, and an air conditioning system including the same capable of activating or deactivating a freeze prevention function of one or more outdoor units or devices on the basis of weather information of an area in which the one or more outdoor device(s) is installed.

Additionally, embodiments disclosed herein provide an apparatus, a method, and an air conditioning system including the same capable of activating or deactivating a freeze prevention function of one or more outdoor units or devices on the basis of weather information received from an external weather information providing server or weather information input by a user.

Also, embodiments disclosed herein provide an apparatus, a method, and an air conditioning system including the same capable of activating or deactivating a freeze prevention function of one or more outdoor units or devices by using results obtained by comparing weather information with weather conditions for function setting or according to a control command directly input by the user, and allowing the outdoor unit or device to perform a freeze operation by using state and operation information.

According to embodiments disclosed herein, there is provided an apparatus connected to one or more outdoor units or devices and configured to control the one or more outdoor units or devices. The apparatus may activate or deactivate a freeze prevention function of the outdoor units or devices on the basis of weather information of an area in which the outdoor units or devices are installed.

The apparatus may include a first communication module connected to an external weather information providing server to receive the weather information; a communication module configured to compare the weather information with pre-set weather conditions and generate a signal for activating or deactivating the freeze prevention function of the outdoor units or devices on the basis of the comparison results; and a second communication module configured to transmit the signal to the outdoor units or devices. The apparatus may further include an input module configured to receive the weather information or receive a control command for activating or deactivating the freeze prevention function.

According to embodiments disclosed herein, there is provided a method for controlling one or more outdoor units or devices by an apparatus connected to the one or more outdoor units or devices and configured to control the one or more outdoor units or devices, which may include receiving weather information of an area in which the one or more outdoor units or devices are installed; comparing the weather information with pre-set weather conditions; and activating or deactivating the freeze prevention function on the basis of the comparison results.

In receiving the weather information, the apparatus may be connected to an external weather information providing server wirelessly or through a wireline to receive the weather information or receive weather information directly from the user.

The method may further include receiving state information and operation information from the one or more outdoor units or devices; comparing the state information and the operation information with the operation conditions for performing the freeze prevention function of a corresponding outdoor unit or device; and starting or terminating the freeze prevention function of the corresponding outdoor unit or device on the basis of the comparison results.

According to another embodiment disclosed herein, there is provided an air conditioning system which may include one or more outdoor units or devices installed at an outer side of a building and configured to perform air conditioning for the building; and an apparatus connected to an external weather information providing server to receive weather information of an area in which the one or more outdoor units or devices are installed, and activating or deactivating a freeze prevention function of the one or more outdoor units or devices on the basis of the weather information.

The apparatus may include a first communication module configured to receive the weather information; a comparison module configured to compare the weather information with pre-set weather conditions and generate a signal for activating or deactivating the freeze prevention function of the one or more outdoor units or devices on the basis of the comparison results; and a second communication module configured to transmit the signal to the one or more outdoor units or devices.

The apparatus may further include an input module configured to receive the weather information or receive a control command for activating or deactivating the freeze prevention function, and the comparison module may compare the weather information received via the first communication module or the weather information received via the input module with the weather conditions.

The apparatus may further include a storage module configured to store the weather information received via the first communication module or received via the input module.

The second communication module may receive state information and operation information from each of the one or more outdoor units or devices, and the comparison module may compare the state information and the operation information with the pre-set operation conditions for performing the freeze prevention function of the corresponding outdoor unit or device, and start or terminate the freeze prevention function of the corresponding outdoor unit or device on the basis of the comparison results.

The air conditioning system may further include one or more gateways connected between the apparatus and the one or more outdoor units or devices. The one or more gateways may receive the state information and operation information of the outdoor units or devices from the outdoor units or devices, transmit the received information to the apparatus, and deliver the signal to the outdoor units or devices.

The apparatus and the gateways may be connected through the Internet. Further, the gateways and the outdoor units or devices may be connected through one or more communication schemes, including, but not limited to wireless communication, serial communication, pipe communication, power line communication, and LAN.

When the freeze prevention function has been set according to the signal, the outdoor units or devices may compare the state information and operation information of the outdoor units or devices with the operation conditions for performing the freeze prevention function and start or terminate the freeze prevention function on the basis of the comparison results.

According to embodiments disclosed herein, the freeze prevention function of an outdoor unit or device may be activated or deactivated on the basis of weather information of an area in which the outdoor unit or device is installed, thus preventing the outdoor unit or device from being covered with snow or frozen and reducing the possibility of system failure, thereby improving stability of the system.

According to embodiments disclosed herein, the freeze prevention function of an outdoor unit or device may be activated or deactivated from a remote area on the basis of weather information received from an external weather information providing server or weather information input by a user, and so on, and accordingly, user convenience may be improved and an energy waste, such as power consumption, may be reduced.

According to embodiments disclosed herein, the freeze prevention function of an outdoor unit or device may be activated or deactivated by using comparison results obtained by comparing weather information with weather conditions for function activating or according to a control command directly input by the user, and freeze prevention may be performed by using state and operation information of the outdoor unit or device. Thus, the stability and operation efficiency of the outdoor unit or device and the air conditioning system including the same.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An apparatus in communication with and configured to control one or more outdoor devices, wherein the apparatus comprises:

a first communication module connected to an external weather information providing server and configured to receive a weather information of an area in which the one or more outdoor devices are installed;

a comparison module configured to compare the weather information with pre-set weather conditions and generate a signal for activating or deactivating the freeze prevention function of the one or more outdoor devices based on comparing the weather information with the pre-set weather condition; and a second communication module configured to transmit the signal to the one or more outdoor devices, wherein the apparatus activates or deactivates a freeze prevention function of the one or more outdoor devices on the basis of the signal for activating or deactivating the freeze prevention function, wherein when the freeze prevention function of the one or more outdoor devices is activated, the apparatus compares state information and operation information of the corresponding one or more outdoor devices with pre-set operation conditions in order to start or terminate the freeze prevention function of the corresponding one or more outdoor devices, and starts or terminates the freeze prevention function of the corresponding outdoor device based on the comparing of the state information and the operation information with the pre-set operation conditions, wherein the state information and the operation information are received from each of the one or more outdoor devices, wherein the one or more outdoor devices, for which the freeze prevention function is started, drive a fan of the corresponding one or more outdoor devices at a predetermined speed for a predetermined period of time, and wherein the weather information includes information related to temperature, humidity, rainfall probability, an amount of rainfall, a probability of precipitation, and/or an amount of precipitation.

2. The apparatus of claim 1, further including:

an input module configured to receive the weather information or receive a control command for activating or deactivating the freeze prevention function.

3. The apparatus of claim 2, further including:

a storage module configured to store the weather information received via the first communication module or received via the input module.

4. The apparatus of claim 1, wherein the apparatus is configured to communicate with the external weather information providing server either wirelessly or through a wireline.

5. The apparatus of claim 1, wherein the apparatus is configured to communicate with the one or more outdoor devices either wirelessly or through a wireline.

6. The apparatus of claim 1, wherein the apparatus includes a remote control apparatus in communication with and configured to remotely control the one or more outdoor devices.

7. The apparatus of claim 1, wherein the pre-set operation conditions include one or more weather conditions with respect to the corresponding one or more outdoor devices.

8. The apparatus of claim 7, wherein the one or more weather conditions do not correspond to the weather information.

9. The apparatus of claim 1, wherein when the freeze prevention function of the corresponding one or more outdoor devices is deactivated, the apparatus does not start the freeze prevention function of the corresponding one or more outdoor devices.

10. The apparatus of claim 9, wherein if the apparatus determines that the state information and the operation information meet the pre-set operation conditions, the corresponding one or more outdoor devices do not drive the fan according to the freeze prevention function when the freeze prevention function of the corresponding one or more outdoor devices is deactivated.

11. An air conditioning system, comprising:

one or more outdoor devices installed at an outer side of a building and configured to perform air conditioning for the building, and an apparatus connected to an external weather information providing server, the apparatus being configured to receive weather information of an area in which the one or more outdoor devices are installed and activate or deactivate a freeze prevention function of the one or more outdoor devices on the basis of the weather information, wherein the apparatus includes:

a first communication module configured to receive the weather information from the external weather information providing server;

a comparison module configured to compare the weather information with pre-set weather conditions and generate a signal for activating or deactivating the freeze prevention function of the one or more outdoor devices based on comparing the weather information with the pre-set weather conditions; and a second communication module configured to transmit the signal to the one or more outdoor devices, wherein when the freeze prevention function of the one or more outdoor devices is activated, the apparatus compares state information and operation information of the corresponding one or more outdoor devices with pre-set operation conditions in order to start or terminate the freeze prevention function of the corresponding one or more outdoor devices, and starts or terminates the freeze prevention function of the corresponding outdoor device based on the comparing of the state information and the operation information with the pre-set operation conditions, wherein the state information and the operation information are received from each of the one or more outdoor devices, wherein the one or more outdoor devices, for which the freeze prevention function is started, drive a fan of the corresponding one or more outdoor devices at a predetermined speed for a predetermined period of time, and wherein the weather information includes information related to temperature, humidity, rainfall probability, an amount of rainfall, a probability of precipitation, and/or an amount of precipitation.

12. The air conditioning system of claim 11, wherein the apparatus further includes:

an input module configured to receive the weather information or receive a command for activating or deactivating the freeze prevention function, and wherein the comparison module compares the weather information received via the first communication module or the weather information received via the input module with the pre-set weather conditions.

13. The air conditioning system of claim 11, wherein the apparatus further includes:

a storage module configured to store the weather information received via the first communication module or received via the input module.

14. The air conditioning system of claim 11, wherein the second communication module receives the state information and the operation information from each of the one or more outdoor devices, and the comparison module compares the state information and the operation information with the pre-set operation conditions in order to start or terminate the freeze prevention function for the corresponding outdoor device.

15. The air conditioning system of claim 14, further including:

one or more gateways connected between the apparatus and the one or more outdoor devices, wherein the one or more gateways receive the state information and the operation information of the one or more outdoor devices from the one or more outdoor devices, transmit the received state information and the received operation information to the apparatus, and deliver the signal to the one or more outdoor devices.

16. The air conditioning system of claim 15, wherein the apparatus and the one or more gateways are connected through the Internet.

17. The air conditioning system of claim 15, wherein the one or more gateways and the one or more outdoor devices are connected through one or more communication schemes among wireless communication, serial communication, pipe communication, power line communication, and LAN.

18. The air conditioning system of claim 15, wherein when the freeze prevention function has been activated according to the signal, the one or more outdoor devices compare their respective state information and operation information with the pre-set operation conditions for starting or terminating the freeze prevention function.

19. The air conditioning system of claim 11, wherein the apparatus is configured to communicate with the external weather information providing server either wirelessly or through a wireline.

20. The air conditioning system of claim 11, wherein the apparatus is configured to communicate with the one or more outdoor devices either wirelessly or through a wireline.

21. The air conditioning system of claim 11, wherein the apparatus includes a remote control apparatus in communication with and configured to remotely control the one or more outdoor devices.

22. A method for controlling one or more outdoor devices using an apparatus connected to the one or more outdoor devices, the method comprising:

receiving weather information of an area in which the one or more outdoor devices are installed;

comparing the weather information with pre-set weather conditions;

activating or deactivating a freeze prevention function on the basis of the comparison results based on the comparing of the weather information with pre-set weather conditions; and when the freeze prevention function of the one or more outdoor devices is activated, receiving state information and operation information from the corresponding one or more outdoor devices, comparing the state information and the operation information with pre-set operation conditions to perform the freeze prevention function of the corresponding one or more outdoor devices, and starting or terminating the freeze prevention function of the corresponding one or more outdoor devices based on the comparing of the state information and the operation information with the pre-set operation conditions, wherein the one or more outdoor devices, for which the freeze prevention function is started, drive a fan of the corresponding one or more outdoor devices at a predetermined speed for a predetermined period of time, wherein, in the receiving the weather information, the apparatus is connected to the external weather information providing server, either wirelessly or through a wireline, to receive the weather information, or receives the weather information directly from a user, and wherein the weather information includes information related to temperature, humidity, rainfall probability, an amount of rainfall, a probability of precipitation, and/or an amount of precipitation.

23. The method of claim 22, wherein the method include a method for remotely controlling the one or more outdoor devices using a remote control apparatus connected to the one or more outdoor devices.

24. An apparatus in communication with one or more outdoor devices, the apparatus including:

a processor configured to receive weather information of an area in which the one or more outdoor devices are installed, generate a signal for activating or deactivating a freeze prevention function of the one or more outdoor devices on the basis of the weather information, and transmit the signal to the one or more outdoor devices, wherein when the freeze prevention function of the one or more outdoor devices is activated, the apparatus compares state information and operation information of the corresponding one or more outdoor devices with pre-set operation conditions in order to start or terminate the freeze prevention function of the corresponding one or more outdoor devices, and starts or terminates the freeze prevention function for the corresponding outdoor device based on the comparing of the state information and the operation information with the pre-set operation conditions, wherein the state information and the operation information are received from each of the one or more outdoor devices, wherein the one or more outdoor devices, for which the freeze prevention function is started, drive a fan of the corresponding one or more outdoor devices at a predetermined speed for a predetermined period of time, wherein the apparatus is configured to communicate with the weather information providing server either wirelessly or through a wireline to obtain the weather information of an area in which the one or more outdoor devices are installed, and wherein the weather information includes information related to temperature, humidity, rainfall probability, an amount of rainfall, a probability of precipitation, and/or an amount of precipitation.

25. The apparatus of claim 24, wherein the processor compares the weather information with pre-set weather conditions and generates the signal for activating or deactivating the freeze prevention function of the one or more outdoor devices based on the comparing of the weather information with the pre-set weather conditions.

26. The apparatus of claim 25, wherein the processor is configured to receive via an input module the weather information or a control command for activating or deactivating the freeze prevention function.

27. The apparatus of claim 26, wherein the processor is configured to store the received weather information.

28. The apparatus of claim 24, wherein the apparatus is configured to communicate with the one or more outdoor devices either wirelessly or through a wireline.

29. The apparatus of claim 24, wherein the apparatus further includes a remote control apparatus in communication with and configured to remotely control the one or more outdoor devices.

* * * * *